US008561693B2

(12) United States Patent
Mydur et al.

(10) Patent No.: US 8,561,693 B2
(45) Date of Patent: Oct. 22, 2013

(54) MOBILE WELL SERVICES ASSEMBLY

(75) Inventors: Ravicharan Mydur, Asker (NO); Jean-Louis Pessin, Houston, TX (US); Mike Wedge, Sugar Land, TX (US); Pavan Katte Vadirajachar, Ghorpadi (IN)

(73) Assignee: Schlumberger Technology Corporation, Sugar Land, TX (US)

( * ) Notice: Subject to any disclaimer, the term of this patent is extended or adjusted under 35 U.S.C. 154(b) by 523 days.

(21) Appl. No.: 12/105,707

(22) Filed: Apr. 18, 2008

(65) Prior Publication Data

US 2009/0260804 A1 Oct. 22, 2009

(51) Int. Cl.
*E21B 47/01* (2012.01)

(52) U.S. Cl.
USPC ..... 166/250.01; 166/77.1

(58) Field of Classification Search
USPC ..... 166/250.01, 254.2, 77.1, 177.1, 177.2; 175/161; 367/25–35, 57; 366/53
See application file for complete search history.

(56) References Cited

U.S. PATENT DOCUMENTS 2,851,121 A * 9/1958 McCollum ..... 367/59
4,056,164 A * 11/1977 Johnston ..... 181/114
4,871,045 A * 10/1989 Cole ..... 181/114
6,003,598 A * 12/1999 Andreychuk ..... 166/76.1
6,170,573 B1 * 1/2001 Brunet et al. ..... 166/153
6,260,656 B1 7/2001 Orban et al.
6,341,705 B1 * 1/2002 Kaspar ..... 212/302
6,488,088 B1 12/2002 Kohli et al.
6,939,031 B2 9/2005 Pham et al.
7,077,209 B2 7/2006 McCulloch et al.
7,249,629 B2 * 7/2007 Cunningham et al. ..... 166/77.1
2004/0065874 A1 * 4/2004 Newman ..... 254/360
2009/0084558 A1 * 4/2009 Bloom ..... 166/385
2009/0157318 A1 * 6/2009 Woerpel et al. ..... 702/9

* cited by examiner

*Primary Examiner* — Kenneth L Thompson
*Assistant Examiner* — James Sayre
(74) *Attorney, Agent, or Firm* — Jody DeStefanis; John Vereb; Trevor Grove

(57) ABSTRACT

A mobile assembly usable in at least one well services operation includes a chassis, a drum disposed on the chassis having a spooled element disposed thereon for use in the at least one well services operation, a winch disposed on the chassis and attached to the spooled element for raising and lowering the spooled element, an elevation device disposed on the chassis and operable to support the spooled element in the at least one well services operation, at least one acquisition system disposed on the chassis in operable communication with a tool disposed on the spooled element, and a prime mover operable to provide power to at least the drum, the winch, and the elevation device.

21 Claims, 4 Drawing Sheets

MOBILE WELL SERVICES ASSEMBLY

BACKGROUND OF THE INVENTION

The present invention relates generally to a vehicles and the like for conveying well logging and seismic acquisition equipment and, in particular, to a mobile well services assembly for conveying well logging and seismic acquisition equipment.

Well logging jobs typically involve trucks or similar vehicles that are equipped with a drum containing wireline cable as well as equipment to control the tension and speed of the attached drum or winch. When seismic acquisition is desired at the job site, additional equipment, such as an additional vehicle, must be brought in, disadvantageously decreasing efficiency of the logging operation.

It is always desirable to provide a mobile assembly for delivering a plurality of well services including well logging and seismic jobs.

SUMMARY OF THE INVENTION

A mobile assembly usable in at least one well services operation in accordance with an embodiment of the present invention includes a chassis, a drum disposed on the chassis having a spooled element disposed thereon for use in the at least one well services operation, a winch disposed on the chassis and attached to the spooled element for raising and lowering the spooled element, an elevation device disposed on the chassis and operable to support the spooled element in the at least one well services operation, at least one acquisition system disposed on the chassis in operable communication with a tool disposed on the spooled element, and a prime mover operable to provide power to at least the drum, the winch, and the elevation device.

Alternatively, the assembly further comprises an enclosed cabin disposed on the chassis. The acquisition system may be disposed in the enclosed cabin and the enclosed cabin may oscillate with respect to the chassis. Alternatively, the elevation device is operable to oscillate with respect to the chassis. Alternatively, the elevation device is one of a crane and a mast.

Alternatively, the assembly further comprises at least one seismic energy source disposed on the chassis and usable in a seismic well logging operation. Alternatively, the chassis includes a trailer hitch disposed thereon. Alternatively, the chassis is an automotive vehicle. Alternatively, the spooled element is one of a wireline cable, a fiberoptic cable, a slickline cable, and coiled tubing. Alternatively, the at least one acquisition system is a one of a wireline acquisition system, a seismic acquisition system, and a fiber optic acquisition system.

Alternatively, the at least one acquisition system is mounted forward of the elevation device. Alternatively, the assembly further comprises a generator set disposed on the chassis. Alternatively, the elevation device is one of a telescoping mast and an A-frame mast. Alternatively, the elevation device is a mast and wherein the mast further comprises a starwheel connector for engaging with the spooled element.

In another embodiment, the present invention provides a method for performing a well services operation, comprising the steps of: providing a mobile assembly comprising a chassis, an enclosed cabin disposed on and operable to oscillate with respect to the chassis, a drum disposed on the chassis having a spooled element disposed thereon for use in the at least one well services operation, a winch disposed on the chassis and attached to the spooled element for raising and lowering the spooled element, an elevation device disposed on the chassis and operable to support the spooled element in the at least one well services operation, at least one acquisition system disposed on the chassis in operable communication with a tool disposed on the spooled element, and a prime mover operable to provide power to at least the drum, the winch, and the elevation device, raising the elevation device, lowering the tool and spooled element into the wellbore, performing a well services operation, and raising the tool and spooled element from the wellbore.

Alternatively, performing comprises gathering information from the tool and transmitting the information from the tool to the at least one acquisition system. Alternatively, the at least one acquisition system is a one of a wireline acquisition system, a slickline acquisition system, a seismic acquisition system, and a fiber optic acquisition system. Alternatively, the spooled element is one of a wireline cable, a fiberoptic cable, slickline cable, and coiled tubing. Alternatively, the method further comprise providing at least one seismic energy source disposed on the chassis and usable in a seismic well services operation. Alternatively, the chassis includes a trailer hitch disposed thereon. Alternatively, the chassis is an automotive vehicle.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION OF THE INVENTION

Figure 1:
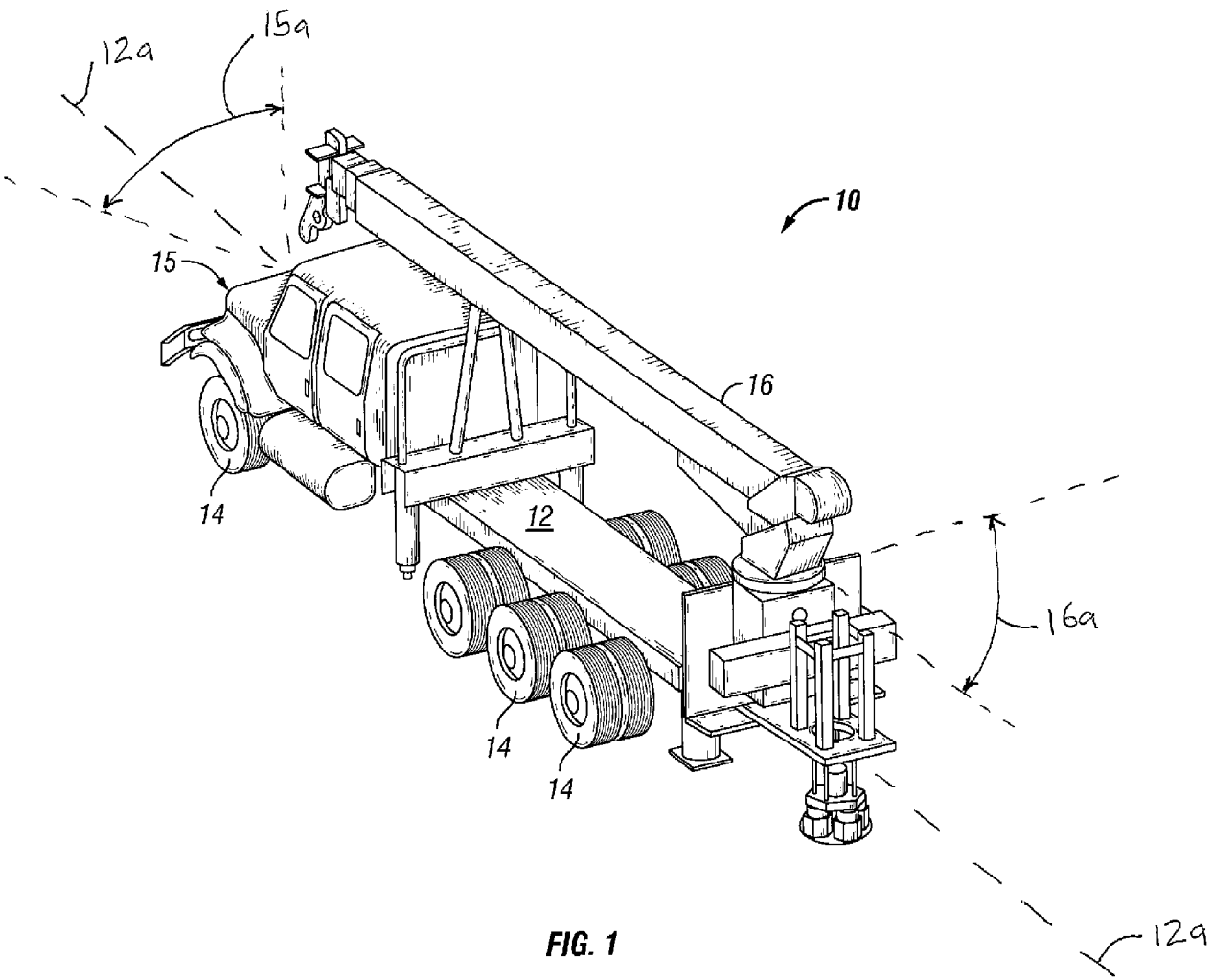
FIG. 1 is a schematic perspective view of a mobile well services assembly in accordance with an embodiment of the present invention.
Figure 2:
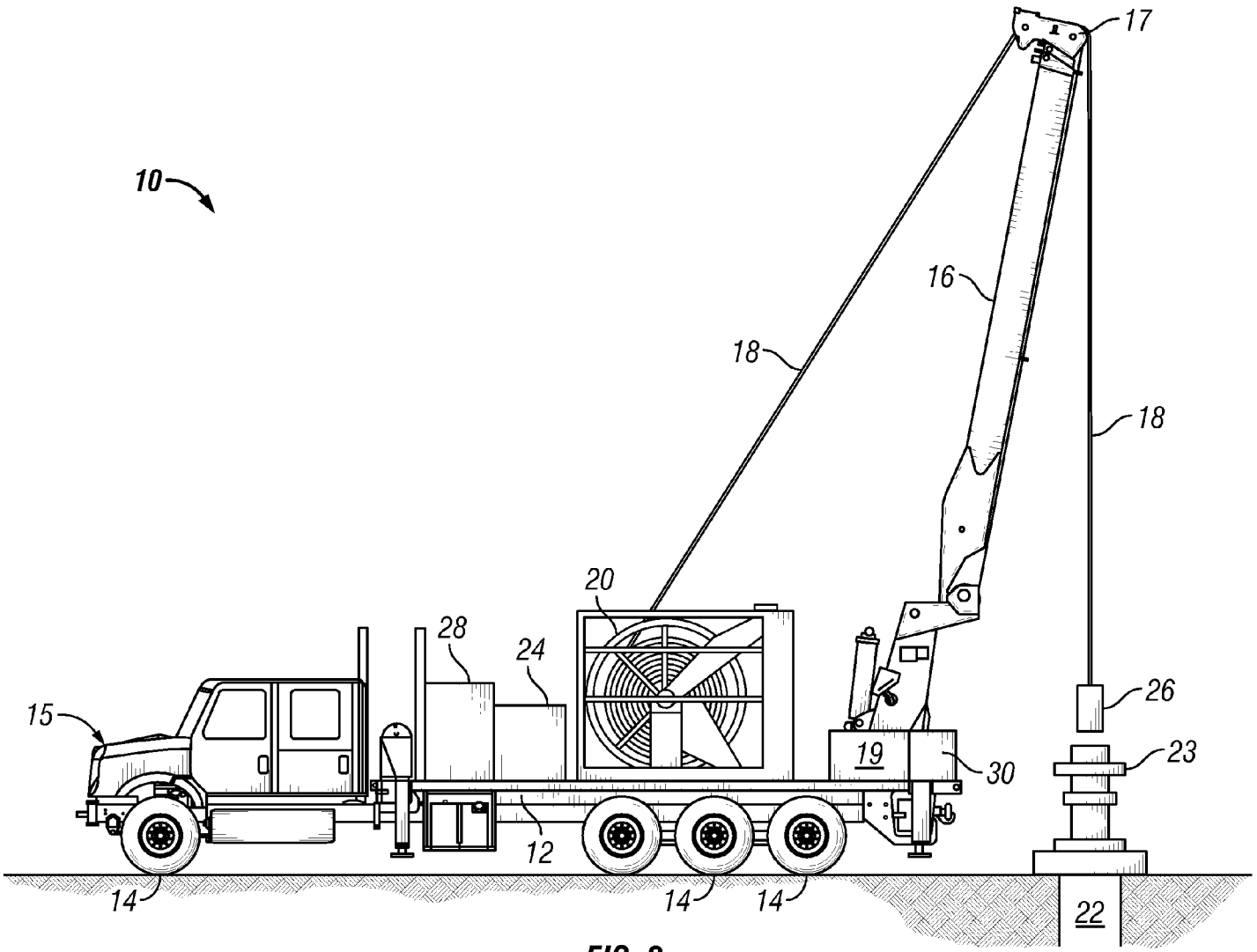
FIG. 2 is a schematic side view of the mobile well services assembly of FIG. 1.
Figure 3:
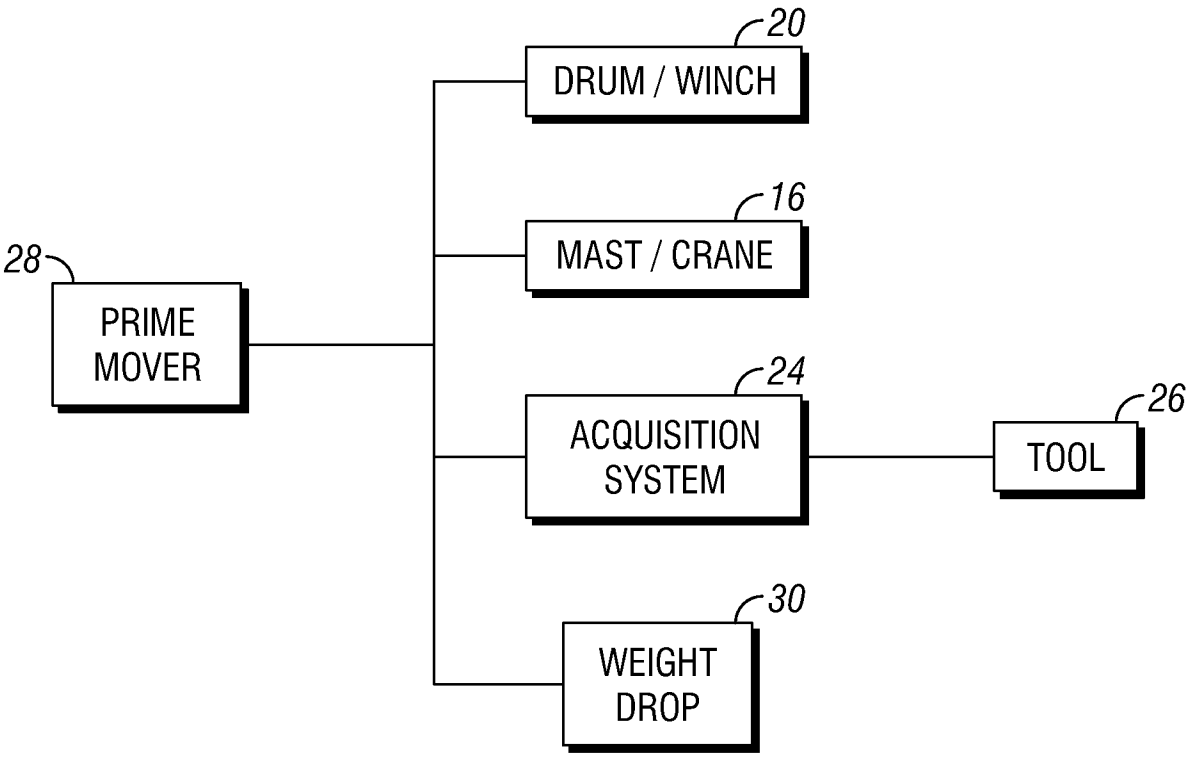
FIG. 3 is a schematic block diagram of components of the mobile well services assembly of FIGS. 1 and 2.
Figure 4:
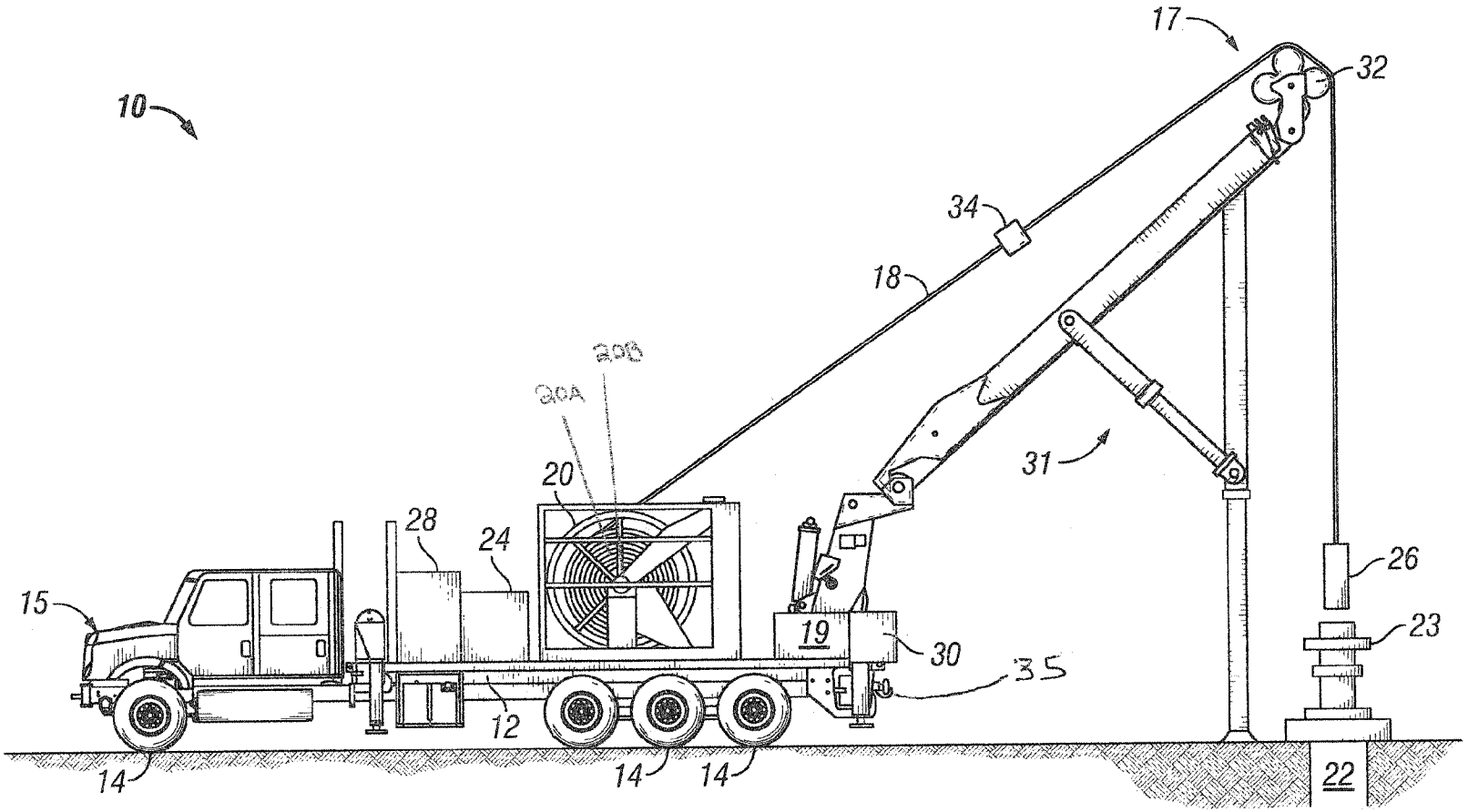
FIG. 4 is a schematic view of an alternative embodiment of an elevation device for use in an embodiment of a system in accordance with the present invention.

Referring now to FIGS. 1-4, there is shown a mobile well services assembly according to an embodiment of the present invention, indicated generally at 10. The vehicle 10 includes a chassis or frame 12 having a plurality of wheels 14 attached thereto. The chassis 12 is preferably self-propelled and includes a preferably enclosed truck cabin 15 attached thereto, which preferably includes a suitable driver's compartment, a prime mover 28, such as a diesel engine or the like, for moving the chassis 12 and providing power to the assembly 10, discussed in more detail below. Alternatively, the chassis 12 is adapted to be towed by a separate vehicle (not shown), such as a heavy duty truck, a semi-trailer truck or the like. The chassis 12 may include a trailer hitch 35 disposed thereon.

An elevation device 16, such as a crane, a mast or the like, is preferably rotatably mounted to the chassis 12 and is adapted to support a spooled element 18 extends from a drum and winch assembly 20. The elevation device 16 may comprise a telescoping mast, such as the mast 31 shown in FIG. 4, an A-frame mast, or similar device as will be appreciated by those skilled in the art, and is operable to perform at last one well services operation, such as a well logging operation, discussed in more detail below. The drum and winch assembly 20, wherein the drum is 20A and the winch is 20B, is operable to raise and lower the spooled element 18 into a wellbore 22 or the like via a wellhead assembly 23 while the spooled element 18 is supported by the crane or mast 16, thereby enabling the crane or mast 16 to assist in performing the at least one well logging operation. Alternatively, the crane or mast 16 includes a sheave assembly 17 at a free end thereof. The sheave assembly may comprise a starwheel assembly 32 (best seen in FIG. 4) that allows the sheave assembly 17 to pass a connector 34, a tool 26 or the like attached to the spooled element 18 while the spooled element 18 is raised and/or lowered. The crane or mast 16 also preferably includes an actuator 19, such as an electric motor, a hydraulic motor or the like for raising and lowering the crane or mast 16, deploying supports or the like during operation of the assembly 10.

At least one acquisition system 24 is disposed on the chassis 12 and is in operable communication with a downhole tool 26 disposed on the spooled element 18. The acquisition system 24 comprises at least a wireline logging acquisition system. Alternatively, the acquisition system 24 comprises at least one of a wireline logging acquisition system, a seismic acquisition system, and a fiber optic acquisition system. Alternatively, the acquisition system 24 is disposed in the cabin 16. The tool 26 is preferably, but is not limited to, a logging tool (such as the tool 36) or the like, as will be appreciated by those skilled in the art. A prime mover 28 is disposed on the chassis 12 and is operable to power to at least the drum and winch assembly 20 and the elevation device 16. Alternatively, the prime mover 28 is located remotely from the chassis 12 and provides power to at least the drum and winch assembly 20 and the elevation device 16 by suitable connections. At least one seismic energy source 30, such as a weight drop device or the like, is disposed on the chassis 12 for containing and dropping a weight (not shown) for a land seismic acquisition operation, discussed in more detail below. The weights from the weight drop apparatus 30 are utilized for in a seismic acquisition operation, as will be appreciated by those skilled in the art. Alternatively, the weight drop apparatus 30 is a plurality of weight drop devices 30 located at various locations on the chassis 12, as will be appreciated by those skilled in the art. The acquisition system 24 may be disposed in the cabin 15. Alternatively, the acquisition system 24 is disposed in a separate cabin mounted on the chassis 12.

The prime mover 28 is preferably a diesel engine, a power pack or power take-off (PTO) from a diesel engine or the like and is operable to supply power, such as via hydraulic fluid, electrical power, combinations thereof, or by any suitable power transmission. In a non-limiting example and in the embodiment of a self-propelled mobile well services assembly 10, the prime mover 28 is a PTO from the diesel engine of the truck and is disposed adjacent the truck cabin 15. The prime mover 28 supplies power to at least the drum and winch assembly 20, the mast or crane 16 (such as the actuator 19 or the like), and the acquisition system 24, best seen in FIG. 3.

Preferably, the cabin 15 and/or the elevation device 16 oscillate with respect to the chassis or frame 12 to, for example, align with the well head in order to perform a well services operation. The cabin 15 and/or the elevation device 16 are mounted on a turntable (not shown), for example, in order to enable oscillation of the cabin 15 along at least an arc 15*a* with respect to a longitudinal axis 12*a* of the chassis or frame 12 and/or the elevation device 16 along at least an arc 16*a* with respect to the axis 12*a* of the chassis or frame 12, best seen in FIG. 1, as will be appreciated by those skilled in the art.

In operation, the mobile well services assembly 10 is disposed adjacent a wellbore, the cabin 15 and/or the crane or mast 16 is oscillated to align with the wellbore (if applicable), the crane or mast 16 is raised, the drum and winch assembly 20 is actuated to lower the tool 26 on the spooled element 18 through the wellhead assembly 23 and into the wellbore 22. While lowered into the wellbore 22, the tool 26 performs a well logging or servicing task or operation, such as gathering and transmitting information to the acquisition system 24 in a manner well known in the art. When the task or operation is complete, the spooled element 18 and tool 26 are raised by the drum and winch assembly 20, stored on the chassis 12, and the crane or mast 16 is lowered to enable the mobile well services assembly 10 to move to another location and perform another well servicing task.

Alternatively, the weight drop 30 and the drum and winch assembly 20 comprise at least a portion of a feedback control system to aid performing the well logging or services task, such as in a borehole seismic log. In such a system, a rate of ascent (or descent) in a well for the tool 26, such as a logging tool or the like, is correlated to rate and amplitude of a weight drop 30.

Alternatively, the chassis 12 further comprises at least one and preferably a plurality of storage locations for equipment including at least one of sheaves, sondes, interconnection cables, and wireline tools.

The mobile well services assembly 10 advantageously provides an integrated mobile platform that is operable to perform and support seismic, wireline, and fiber optic acquisition. If not utilized for seismic operations, the mobile well services assembly 10 may still be utilized for wireline acquisition operations. The elevation device 16 can be used for regular wellheads and/or slant wellheads and may be positioned in front or behind the acquisition cabin 15. Preferably, the mobile well services assembly 10 is able to support a tension relief system for the drum and winch assembly.

The mobile well services assembly 10 is advantageously self-sustained with either a power pack or PTO, especially in the embodiment where the mobile well services assembly 10 is self-propelled. Alternatively, the mobile well services assembly 10 is trailer based for mobility improvement.

The preceding description has been presented with reference to presently preferred embodiments of the invention. Persons skilled in the art and technology to which this invention pertains will appreciate that alterations and changes in the described structures and methods of operation can be practiced without meaningfully departing from the principle, and scope of this invention. Accordingly, the foregoing description should not be read as pertaining only to the precise structures described and shown in the accompanying drawings, but rather should be read as consistent with and as support for the following claims, which are to have their fullest and fairest scope.

We claim:

1. A mobile assembly usable in at least one well services operation, comprising:

a mobile chassis;

a drum disposed on the chassis having a spooled element disposed thereon for use in the at least well services operation, the spooled element comprising at least one tool disposed thereon for use in the well services operation;

a winch disposed on the chassis and attached to the spooled element for raising and lowering the spooled element into and out of a wellbore during the well services operation;

an elevation device disposed on the chassis and operable to support the spooled element in the at least one well services operation;

at least one acquisition system disposed on the chassis for receiving information from the tool disposed in the wellbore;

a prime mover operable to provide power to at least the drum, the winch, and the elevation device; and at least one seismic energy source disposed on the mobile chassis movable under the chassis to generate a seismic source usable in a seismic well logging operation, the seismic well logging operation distinct from the well services operation.

2. The assembly according to claim 1 further comprising an enclosed cabin disposed on the chassis.

3. The assembly according to claim 2, wherein the acquisition system is disposed in the enclosed cabin.

4. The assembly according to claim 2, wherein the enclosed cabin is operable to oscillate with respect to the chassis.

5. The assembly according to claim 1, wherein the elevation device is operable to oscillate with respect to the chassis.

6. The assembly according to claim 1 wherein the elevation device is one of a crane and a mast.

7. The assembly according to claim 1 wherein the mobile chassis defines a periphery and further wherein the at least one seismic energy source is movable only under the periphery of the chassis.

8. The assembly according to claim 1 wherein the chassis is an automotive vehicle.

9. The assembly according to claim 1 wherein the spooled element is one of a wireline cable, a fiberoptic cable, a slickline cable, and coiled tubing.

10. The assembly according to claim 1 wherein the at least one acquisition system is one of a wireline acquisition system, a seismic acquisition system, and a fiber optic acquisition system.

11. The assembly according to claim 1 wherein the at least one acquisition system is mounted forward of the elevation device.

12. The assembly according to claim 1 further comprising a generator set disposed on the chassis.

13. The assembly according to claim 1 wherein the elevation device is one of a telescoping mast and an A-frame mast.

14. The assembly according to claim 1 wherein the elevation device is a mast and wherein the mast further comprises a starwheel connector for engaging with the spooled element.

15. The assembly according to claim 1, wherein the seismic energy source comprises a weight drop.

16. A method for performing a seismic well logging operation, comprising:

providing a mobile assembly comprising a chassis defining a periphery, an enclosed cabin disposed on and operable to oscillate with respect to the chassis, a drum disposed on the chassis having a spooled element disposed thereon for use in the seismic well logging operation, the spooled element having a tool disposed thereon, a winch disposed on the chassis and attached to the spooled element for raising and lowering the spooled element in the seismic well logging operation, at least one acquisition system disposed on the chassis for receiving information from the tool disposed on the spooled element, and a prime mover operable to provide power to at least the drum, the winch and at least one seismic energy source disposed on the mobile assembly and usable in the seismic well logging operation;

raising an elevation device;

lowering the tool and spooled element into the wellbore;

performing the seismic well logging operation by operating the seismic energy source, gathering information from the tool and transmitting the information from the tool to the at least one acquisition system and correlating a rate of ascent or descent of the tool to a rate of movement of the seismic energy source; and raising the tool and spooled element from the wellbore.

17. The method according to claim 16 wherein the at least one acquisition system is one of a wireline acquisition system, a slickline acquisition system, a seismic acquisition system, and a fiber optic acquisition system.

18. The method according to claim 16 wherein the spooled element is one of a wireline cable, a fiberoptic cable, slickline cable, and coiled tubing.

19. The method according to claim 16 wherein the chassis includes a trailer hitch disposed thereon.

20. The method according to claim 16 wherein the chassis is an automotive vehicle.

21. The method according to claim 16 wherein the seismic energy source comprises a weight drop.

* * * * *